US006261140B1

(12) United States Patent
Yoshida et al.

(10) Patent No.: US 6,261,140 B1
(45) Date of Patent: Jul. 17, 2001

(54) WATER PRECLUSION SYSTEM FOR WATERCRAFT EXHAUST

(75) Inventors: Tatsuya Yoshida; Tadatsugu Yamamura, both of Shizuoka (JP)

(73) Assignee: Yamaha Hatsudoki Kabushiki Kaisha (JP)

( * ) Notice: Subject to any disclaimer, the term of this patent is extended or adjusted under 35 U.S.C. 154(b) by 0 days.

(21) Appl. No.: 09/422,214

(22) Filed: Oct. 19, 1999

(30) Foreign Application Priority Data

Oct. 19, 1998 (JP) ..... 10-296932

(51) Int. Cl.[7] ..... B63H 21/10
(52) U.S. Cl. ..... 440/88; 440/89
(58) Field of Search ..... 440/88, 89; 114/55.5, 114/55.51, 55.52, 55.53, 55.54, 55.55, 55.56, 55.57, 55.58; 181/235, 232

(56) References Cited

U.S. PATENT DOCUMENTS

| | | | | |
|---|---|---|---|---|
| 3,807,527 | * | 4/1974 | Bergson et al. | 181/35 B |
| 4,019,456 | * | 4/1977 | Harbert | 115/73 |
| 4,361,423 | * | 11/1982 | Nitz | 55/100 |
| 5,078,631 | * | 1/1992 | Harbert | 440/89 |
| 5,234,364 | | 8/1993 | Ito . | |
| 5,259,797 | * | 11/1993 | Miles, Jr. et al. | 440/89 |
| 5,493,080 | * | 2/1996 | Moss | 181/232 |
| 5,536,189 | | 7/1996 | Mineo . | |
| 5,702,276 | * | 12/1997 | Nakase et al. | 440/89 |
| 5,746,630 | * | 5/1998 | Ford et al. | 440/89 |
| 5,820,426 | * | 10/1998 | Hale | 440/88 |
| 5,830,022 | * | 11/1998 | Nakase et al. | 440/88 |
| 5,885,121 | * | 3/1993 | Nanami et al. | 440/88 |
| 5,954,553 | * | 9/1999 | Ozawa et al. | 440/89 |
| 5,980,343 | * | 11/1999 | Rolinski | 440/89 |
| 6,019,648 | * | 2/2000 | Lecours et al. | 440/38 |
| 6,024,617 | * | 2/2000 | Smullin et al. | 440/89 |
| 6,041,727 | * | 3/2000 | Yamada et al. | 114/123 |

FOREIGN PATENT DOCUMENTS

| | | | | |
|---|---|---|---|---|
| 1305292 | * | 6/1981 | (GB) | 440/89 |
| 2065036 | * | 6/1981 | (GB) | 440/89 |

OTHER PUBLICATIONS

SeaDoo Parts Catalogue, 1998, 5666 / 5843 GTX RFI, Bombardier, Inc. 4 pages.

SeaDoo Shop Manual 1999, Section 04: ENGINE—787 RFI Engine, Bombardier Inc., 3 pages.

* cited by examiner

*Primary Examiner*—S. Joseph Morano
*Assistant Examiner*—Ajay Vasudeva
(74) *Attorney, Agent, or Firm*—Knobbe, Martens, Olson, & Bear, LLP

(57) ABSTRACT

An exhaust system for a watercraft includes a water trap arranged on a first side of a hull tunnel, a discharge port arranged on a second side of the hull tunnel, and a chamber branched from and communicating with an exhaust passage connecting the watertrap with the discharge port.

26 Claims, 10 Drawing Sheets

WATER PRECLUSION SYSTEM FOR WATERCRAFT EXHAUST

PRIORITY INFORMATION

This application is based on and claims priority to Japanese Patent Application No. 10-296932 filed Oct. 19, 1998.

BACKGROUND OF THE INVENTION

1. Field of the Invention

The present invention is directed to an exhaust system for a watercraft, and more particularly to a water preclusion and noise attenuation system employed in a watercraft exhaust system.

2. Description of Related Art

Personal watercraft have become very popular in recent years. This type of watercraft is quite sporting in nature and carries a rider and possibly one to three passengers. A relatively small hull of the personal watercraft commonly defines a riders' area above an engine compartment. A two-cycle internal combustion engine frequently powers a jet propulsion unit which propels the watercraft. The engine lies within the engine compartment in front of a tunnel formed on the underside of the watercraft hull. The jet propulsion unit is located within the tunnel and is driven by a drive shaft. The drive shaft usually extends between the engine and the jet propulsion device, through a wall of the hull tunnel.

Because of their small size and high degree of maneuverability, however, there are certain objections to the use of these watercraft on some bodies of water. One of these objections is caused by the fact that this type of watercraft, primarily because of its small size, has a relatively simple exhaust system that does not provide a significant degree of silencing. This result is mandated primarily by the very compact nature of the watercraft and the relatively small area that is available for exhaust treatment. Because these watercrafts can be utilized on quite small bodies of water, the potential noise may be more objectionable than larger watercraft having unmuffled exhaust systems but which do not operate on these small bodies of water.

An exhaust system of a typical personal watercraft discharges engine exhaust to the atmosphere either through or close to the body of water in which the watercraft is operating. Although submerged discharge of engine exhaust silences exhaust noise, environmental concerns arise. These concerns are particularly acute in connection with two-cycle engines because engine exhaust from two-cycle engines often contains lubricants, unburned fuel, and other byproducts.

Such environmental concerns have raised a desire to minimize exhaustion of hydrocarbons and other exhaust byproducts (e.g., carbon monoxide and oxides of nitrogen), and thus reduce pollution of the atmosphere and the body of water in which the watercraft is operated. In response to the increased concerns regarding exhaust emissions, some personal watercraft engines recently have been equipped with a catalyst to convert exhaust byproducts to harmless gases.

Catalysts must operate at a relatively high temperature in order to produce the necessary thermal reaction and burning of the exhaust byproducts. A catalytic device thus desirably operates within a specific range of temperature so as to effectively and efficiently convert engine exhaust into generally harmless gases.

Some prior exhaust systems have employed a cooling jacket about the catalytic device to maintain the catalytic device within the desired temperature range. In some systems, at least a portion of the cooling water also is introduced into the stream of the exhaust gasses discharged from the engine, not only further cool and silence the exhaust gases, but also to assist the discharge of exhaust gases. The added water to the exhaust system, however, gives rise to possible damage to the catalyst.

In order to prevent water from entering the exhaust system which could therefore damage the engine and/or catalyst, it is been known to provide watercraft with a device commonly referred to as a "watertrap" (a.k.a. "waterlock" or "water box"). A watertrap typically includes an inlet, an outlet, and a plurality of baffles defining open chambers which under certain operating conditions contain water. Typically, the watertrap is arranged in the exhaust system downstream from the engine exhaust manifold and upstream from a discharge port of the exhaust system. The exhaust gases and water flow through the chambers within the watertrap while the chambers generally prevent water from moving back through the watertrap and upstream through the exhaust system towards he engine exhaust manifold and/or the catalyst during abrupt watercraft movements or if he watercraft is capsized. If a watercraft is capsized, a significant amount of water may flow into the watertrap from the portion of the exhaust system piping downstream from the watertrap, thereby forcing a substantial amount of water upstream into the exhaust system and fowling and/or damaging the internal combustion engine and/or shattering the catalyst bed of the exhaust system.

Exhaust noise also posses problems for personal watercraft use. Despite recent attempts to reduce the noise generated by and emissions discharged from personal watercraft powered by two-cycle engines, certain recreational facilities have banned the operation of two-cycle watercraft. Such bans have resulted in a decrease in popularity of personal watercraft powered by two-cycle engines.

SUMMARY OF THE INVENTION

A need exists for an exhaust system for a watercraft which includes a water preclusion system that further reduces the possibility of water flowing upstream in the exhaust system during high speed operation and/or capsizing, and which does not cause undue back pressure in the exhaust system which may reduce the power output of the engine of the watercraft. Additionally, it is desirable that such a system further attenuate exhaust noise and is compact in size, utilizing the relatively compact spaces that are typically available in the hulls of personal watercraft.

According to one aspect of the present invention, a watercraft includes an exhaust system having an exhaust passage extending between an exhaust manifold of an engine and an exhaust discharge port provided on a first side of a hull tunnel of a hull of a watercraft. According to the present aspect of the invention, the exhaust passage includes a watertrap device provided on a second side of the hull tunnel opposite the first side and an intermediate portion extending between the watertrap device and the discharge port. The intermediate portion extends above a top of the hull tunnel and includes a chamber branched from and communicating with the intermediate portion. By providing a chamber branched from and communicating with the intermediate portion of the exhaust passage, where the intermediate portion extends above a top of the hull tunnel of the watercraft, the present aspect of the invention achieves the conflicting goals of preventing the upstream flow of water through the exhaust system while avoiding additional back pressure in the exhaust system.

For example, by providing the watertrap device on the side of the hull tunnel opposite the exhaust discharge port and providing the branched chamber in the portion of the exhaust passage that extends above a top of the hull tunnel, the exhaust system provides an additional chamber for trapping water that may flow into the exhaust discharge port of the watercraft during high speed maneuvering or capsizing. Furthermore, since the chamber is branched from the intermediate portion, the chamber does not generate large back pressures in the exhaust system during operation of the internal combustion engine. Additionally, the branched chamber could optionally be tuned so as to form a heimholtz resonator, so as to provide additional noise dampening of the internal combustion engine. Therefore, despite being capsized, the watercraft can adequately prevent permanent damage to the engine and/or catalyst bed, provide additional noise suppression of exhaust, while avoiding the generation of additional back pressures in the exhaust system.

Further aspects, features, and advantages of the present invention will become apparent from the detailed description of the preferred embodiment which follows.

BRIEF DESCRIPTION OF THE DRAWINGS

The above-mentioned and other features of the invention will now be described with reference to the drawings of a preferred embodiment of the present watercraft exhaust system. The illustrated embodiments of the watercraft are intended to illustrate, but not to limit the invention. The drawings contain the following figures.

DETAILED DESCRIPTION OF THE PREFERRED EMBODIMENT

An improved exhaust system for a watercraft is disclosed herein. The exhaust system includes an enhances noise attenuation and water preclusion system which does not significantly increase backpressure within the system. Thus, engine performance is not significantly impacted despite quieter watercraft operation.

Figure 1:
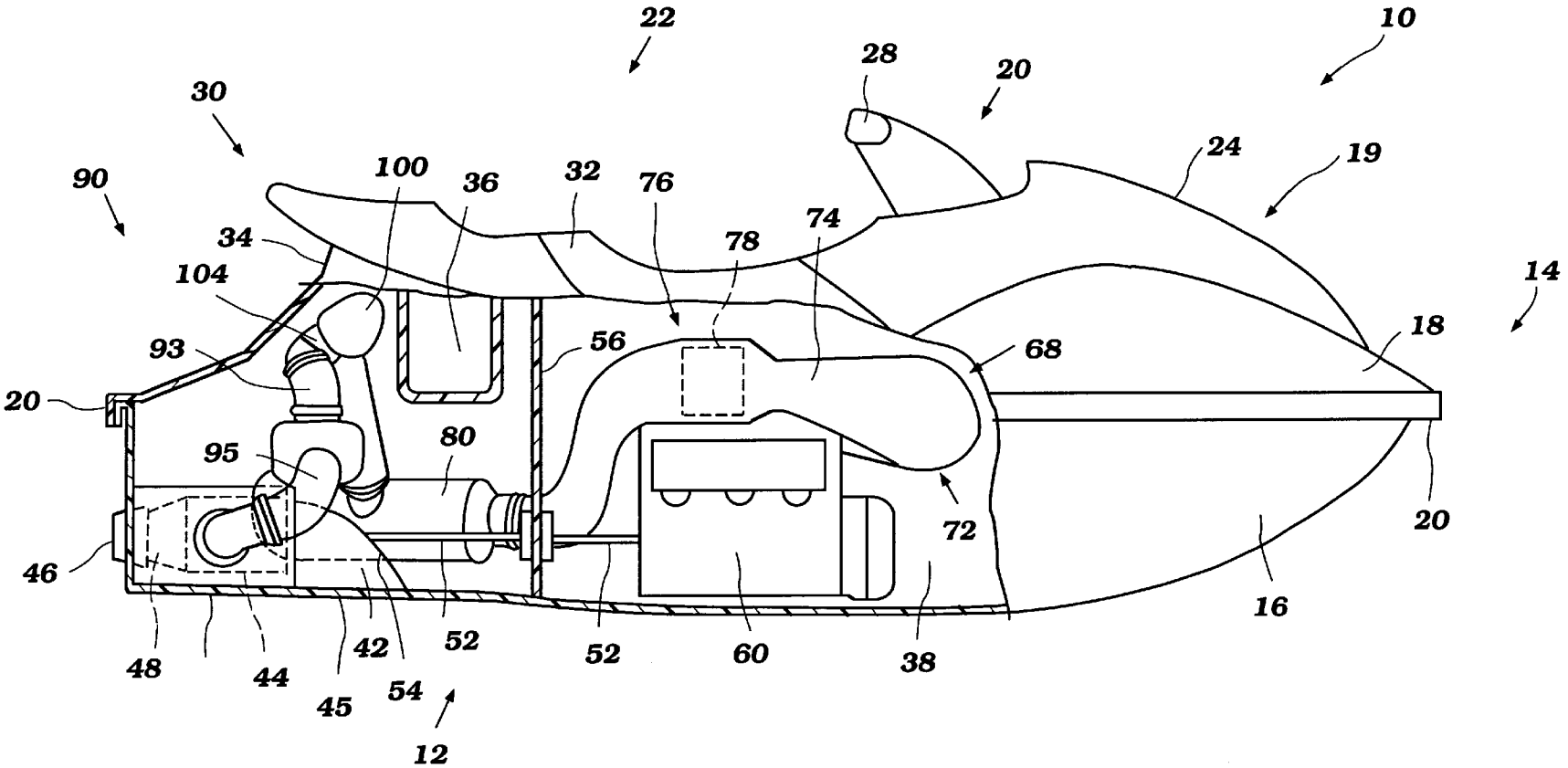
FIG. 1 is a partial sectional, side elevational view of a personal watercraft including an exhaust system configured in accordance with a preferred embodiment of the present invention.

FIG. 1 illustrates a personal watercraft 10 which includes an exhaust system 12 configured in accordance with a preferred embodiment of the present invention. Although the present exhaust system 12 is illustrated in connection with a personal watercraft, the illustrated exhaust system can be used with other types of watercraft as well, such as, for example, but without limitation, small jet boats and the like. Before describing the exhaust system 12, an exemplary personal watercraft 10 will first be described in general details to assist the reader's understanding of the environment of use and the operation of the exhaust system 12.

The watercraft 10 includes a hull 14 formed by a lower hull section 16 and an upper deck section 18. The hull sections 16, 18 are formed from a suitable material such as, for example, a molded fiberglass reinforced resin (e.g., SMC). The lower hull section 16 and the upper deck section 18 are fixed to each other around the peripheral edges 20 in any suitable manner.

As viewed in the direction from the bow to the stern of the watercraft, the upper deck section 18 includes a bow portion 19, a control mast 20 and a rider's area 22. The bow portion 19 slopes upwardly toward the control mast 20 and includes at least one air duct through which air can enter the hull. A hatch cover 24 desirably extends above an upper end of the air duct to inhibit an influx of water into the hull.

Figure 8:
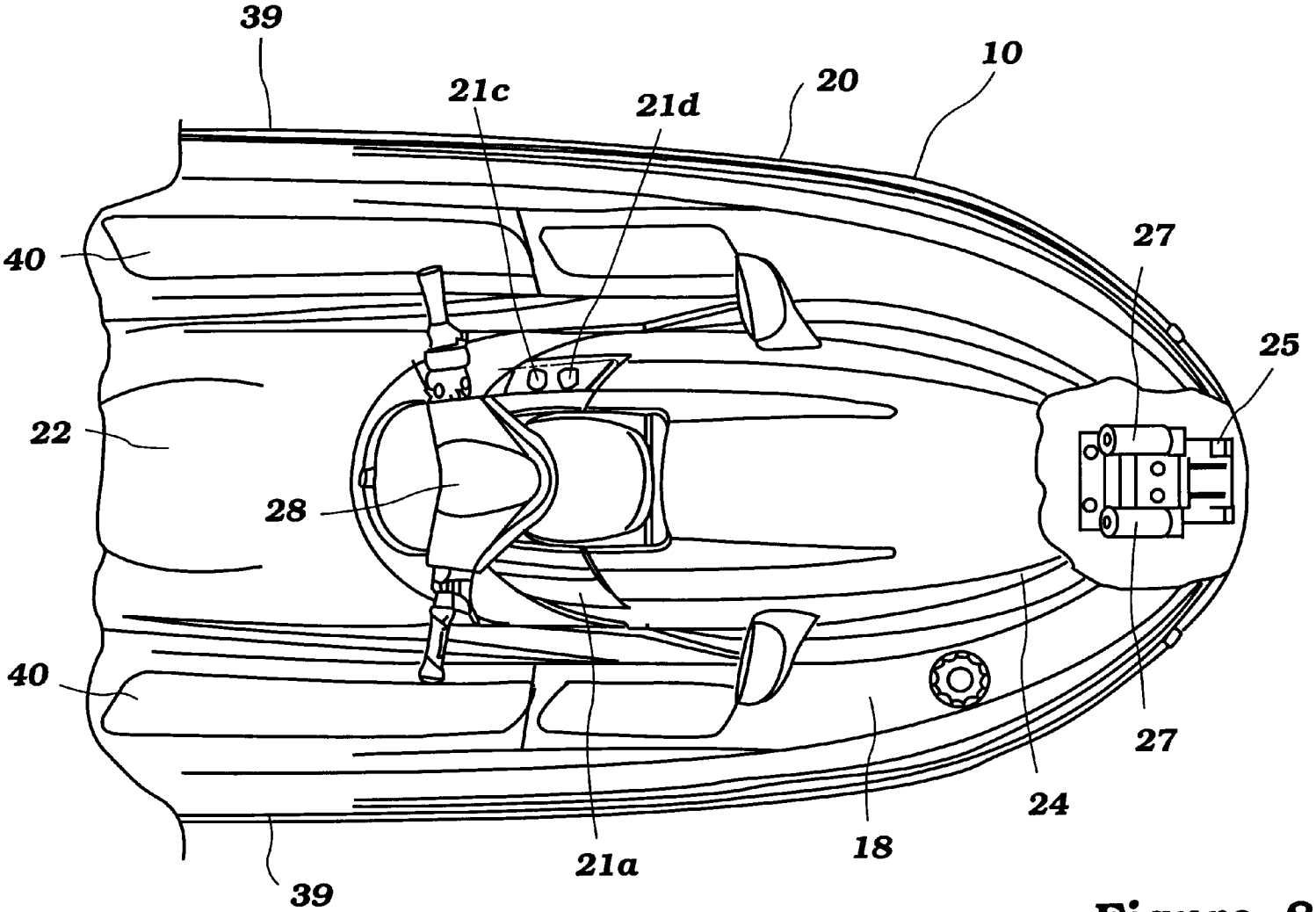
FIG. 8 is a partial top plan view of the watercraft shown in FIG. 1.
Figure 9:
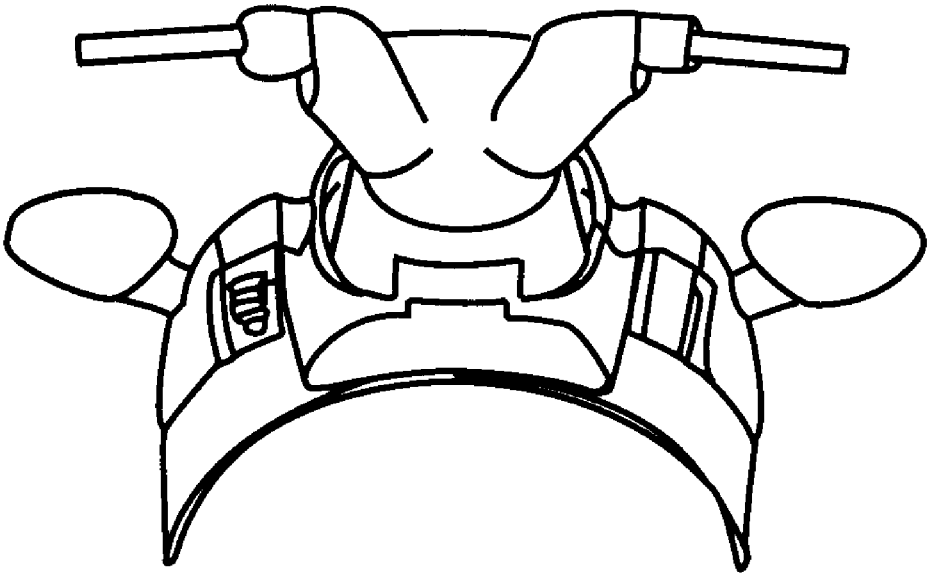
FIG. 9 is a rear elevational view of the control mast of the watercraft shown in FIG. 1.
Figure 10:
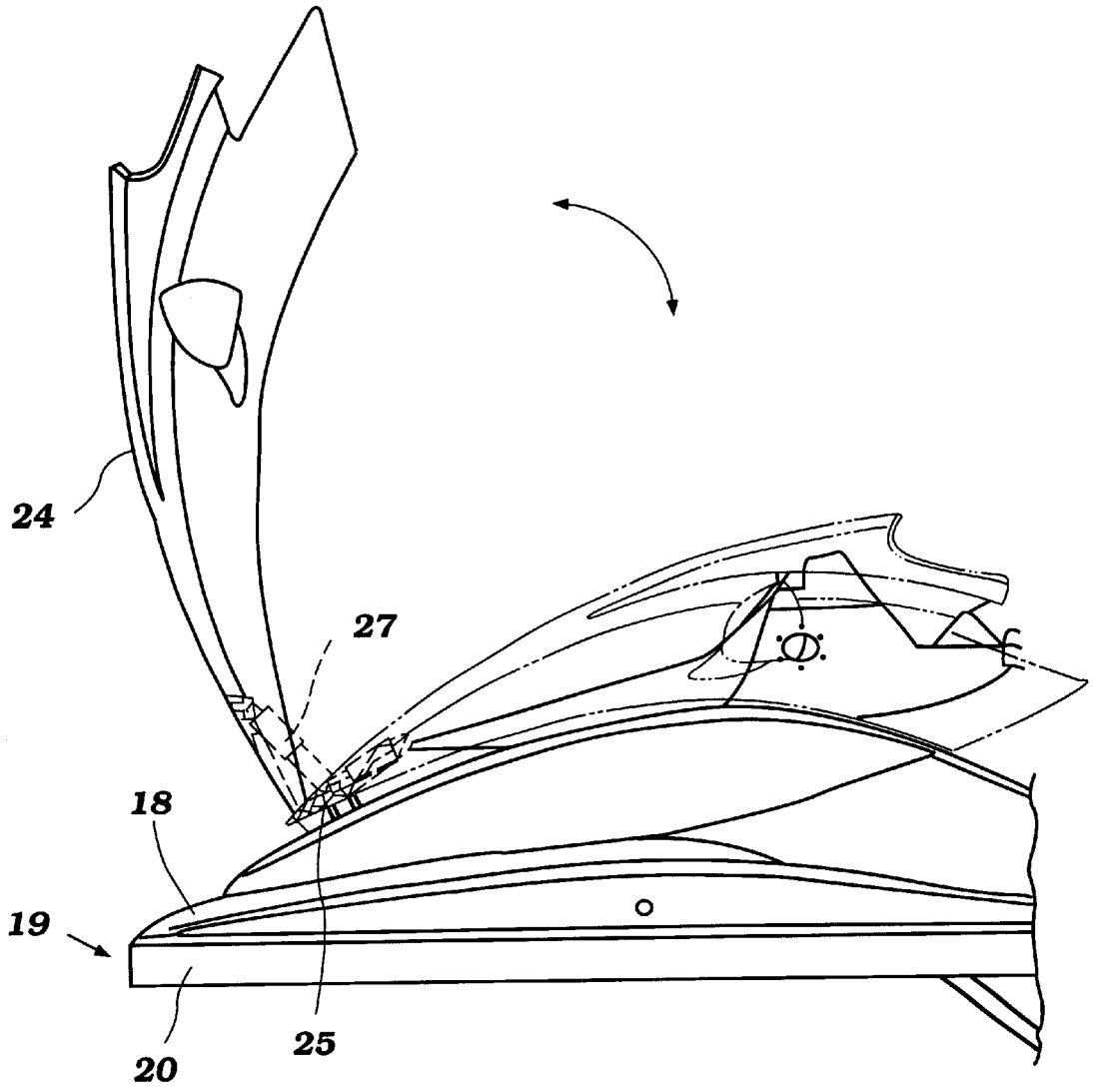
FIG. 10 is a partial side elevational view of the watercraft shown in FIG. 1, illustrating the movement of a hatch.
Figure 11:
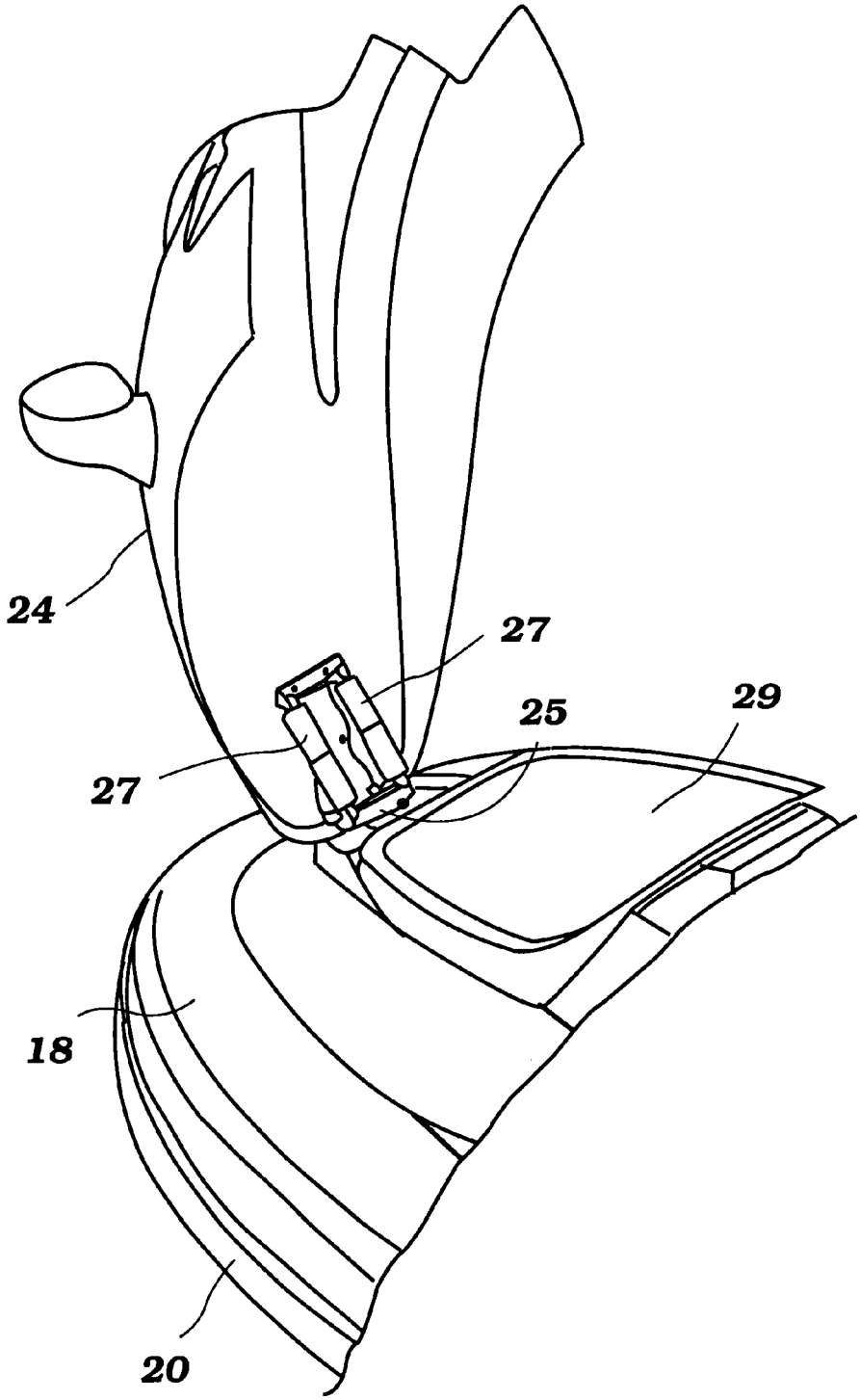
FIG. 11 is a partial prospective view of the watercraft shown in FIG. 1 with the hatch in an open position.

The hatch cover 24 is preferably attached to the upper deck section 18 via a hinge 25. Additionally, as shown in FIGS. 8, 10 and 11, pneumatic cylinders 27 are mounted adjacent the hinge 25 so as to bias the hatch 24 to an open position, thereby enabling a user to easily open the hatch 24. Furthermore, by providing two pneumatic cylinders 27, the hatch 24 can be raised, lowered and maintained in an open position in a stable manner. The cylinders 27 also inhibit twisting of the hatch and thereby strengthen the hinged coupling. Also as shown in FIG. 11, the hatch 24 provides access to a access hole 29 which may be used to provide access to a storage compartment for storing a fuel tank or any other desired item.

A fuel tank (not shown) is preferably located within the hull 14 beneath the hatch over 24. Conventional means, such as, for example, straps, are preferably used to secure the fuel tank to the lower hull 16.

The control mast 20 extends upward from the bow portion 19 and supports a handlebar assembly 28. The handlebar 28 controls the steering of the watercraft 10 in a conventional manner. The handlebar assembly 28 also carries a variety of controls of the watercraft 10, such as, for example, a throttle control, a start switch and a lanyard switch.

A display panel (not shown) is desirably located in front of the control mast 20 on the bow portion 19 and is orientated to be visible by the rider. The display panel desirably displays a number of performance characteristics of the watercraft such as for example, watercraft speed (via a speedometer), engine speed (via a tachometer), fuel level, oil level, engine temperature, battery charge level and the like. As shown in FIG. 8, the cowling adjacent the control mast 20 preferably includes a reverse lever 21*a*, a fuel cock 21*b*, and a choke 21*c*. These components are arranged to the sides of the control mast 20 and just forward of the same. The reverse lever 21*a* is operatively connected to a conventional reverse thrust bucket (not shown) which is configured to selectively divert water discharged from a propulsion device to cause the watercraft 10 to move in a reversed direction. The fuel cock 21*b* and choke knob 21*c* are arranged on a side of the control mast 20 opposite the reverse lever 21*a*. This arrangement of these components disposes each of them in convenient reach of the watercraft rider when seated just behind the control mast 20.

The rider's area 22 lies behind the control mast 20 and includes a seat assembly 30. In the illustrated embodiment, the seat assembly 30 has a longitudinally extending straddle-type shape that may be straddled by an operator and by at least one to three passengers. The seat assembly 30, at least in principal part, is formed by a seat cushion 32 supported by a raised pedestal 34. The raised pedestal 34 has an elongated shape and extends longitudinally along the center of the watercraft 10. The seat cushion 32 desirably is removably attached to a top surface of the pedestal 34 and covers the entire upper end of the pedestal for rider and passenger comfort.

An access opening (not shown) is preferably located on an upper surface of the pedestal 34. The access opening opens into an engine compartment 38 formed within the hull 14. The seat cushion 32 normally covers and seals an access opening 35. When the seat cushion 32 is removed, the engine compartment 38, as well as a storage cavity 36, are accessible through the access opening.

The pedestal 34 also desirably includes at least one air duct (not shown) located behind the access opening. The air duct communicates with the atmosphere through a space formed between the pedestal 34 and the cushion 32, which is formed behind the access opening. Air can pass through the rear duct in both directions.

Figure 3:
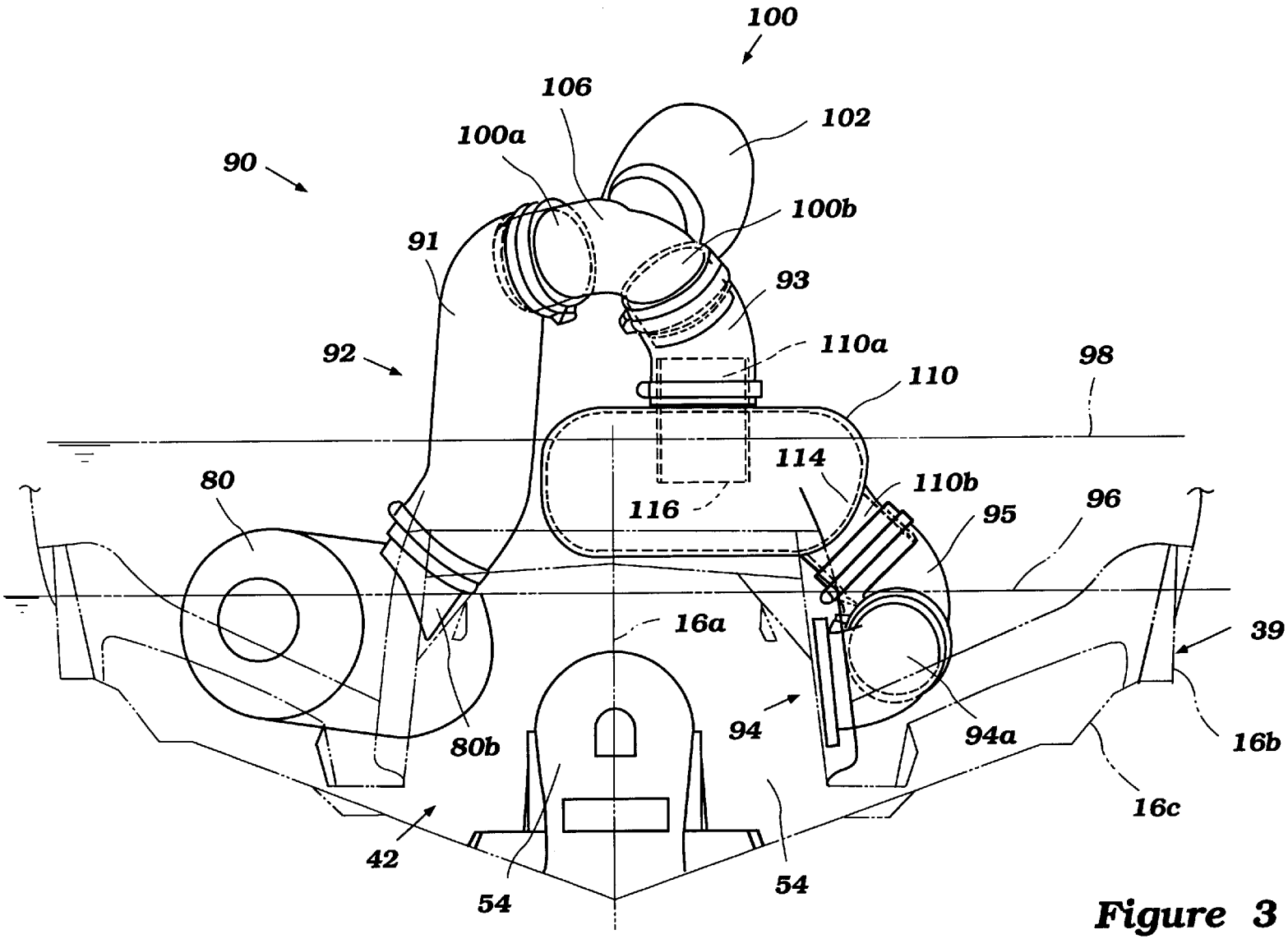
FIG. 3 is a cross-sectional view along line 3—3 of the watercraft shown in FIG. 2

As shown in FIGS. 3 and 8, the upper deck section 18 of the hull 12 advantageously includes a pair of raised gunnels 39 positioned on opposite sides of the aft end of the upper deck assembly 18. The raised gunnels 39 define a pair of foot areas 40, as shown in FIG. 8, that extend generally longitudinally and parallel to the sides of the pedestal 34. In this position, the operator and any passengers sitting on the seat assembly 30 can place their feet in the foot areas 40 with the raised gunnels 39 shielding the feet and lower legs of the riders. A non-slip (e.g., rubber) mat desirably covers the foot areas 40 to provide increased grip and traction for the operator and the passengers.

The lower hull portion 16 principally defines the engine compartment 38. Except for the air ducts, the engine compartment 38 is normally substantially sealed so as to enclose an engine of the watercraft 10 from the body of water in which the watercraft is operated.

The lower hull 16 is designed such that the watercraft 10 planes or rides on a minimum surface area at the aft end of the lower hull 16 in order to optimize the speed and handling of the watercraft 10 when up on plane. For this purpose, as shown in FIG. 3, the lower hull section generally has a V-shaped configuration formed by a pair of inclined sections that extend outwardly from a keel line 16*a* of the hull to the hull's side walls at a dead rise angle. Each inclined section desirably includes at least one strake 16*c*, and the strakes 16*c* of the hull preferably are symmetrically disposed relative to the keel line of the watercraft 10. The inclined sections also extend longitudinally from the bow toward the transom of the lower hull 14. The side walls are generally flat and straight near the stern of the lower hull and smoothly blend towards the longitudinal center of the watercraft at the bow. The lines of intersection between the inclined sections and the corresponding side walls form the outer chines 16*b* of the lower hull section.

Toward the transom of the watercraft, the inclined sections of the lower hull 16 extend outwardly from a recessed channel or tunnel 42 that extends upward toward the upper deck portion 16. As used hereinafter, "recessed channel," "tunnel," and "hull tunnel" are used interchangeably to refer to the portion of the transom end of the watercraft hull that is formed to accommodate a jet of water generated by the watercraft for propulsion purposes. For example, the watercraft 10 includes a jet pump unit 44 which generates a generally rearward directed jet of water to generate a propulsion force to cause forward and/or reverse movement of the watercraft 10.

The jet pump unit 44 is mounted within the tunnel 42 formed on the underside of the lower hull section 16 by a plurality of bolts. An intake duct of the jet pump unit 44 defines an inlet opening 45 that opens into a gullet. The gullet leads to an impeller housing assembly in which the impeller of the jet pump 44 operates. An impeller housing assembly also acts as a pressurization chamber and delivers the water flow from the impeller housing to a discharge nozzle housing.

A steering nozzle 46 is supported at the downstream end of a discharge nozzle 48 by a pair of vertically extending pivot pins. In an exemplary embodiment, the steering nozzle 46 has an integral lever on one side that is coupled to the handlebar assembly 28, for example, a bowden-wire actuator, as known in the art. In this manner, the operator of the watercraft can move the steering nozzle 46 to effect directional changes of the watercraft 10.

A ride plate 50 preferably covers a portion of the tunnel 42 behind the inlet opening 45 to enclose the pump assembly and a nozzle assembly 60 of the propulsion unit. The aft end of an impeller shaft 52 is suitably supported and journaled within the engine chamber of the assembly in a known manner. The impeller shaft 52 extends in the forward direction through a front wall 54 of the tunnel 42 as well as through a bulkhead 56.

An internal combustion engine 60 of the watercraft powers the impeller shaft 52 to drive the impeller of the jet pump unit 44. The engine 60 is positioned within the engine compartment 38 and is mounted primarily beneath the control mast 20. Vibration-absorbing engine mounts (not shown) are preferably used to secure the engine 60 to the lower hull portion 16 in a known manner. The engine 60 is mounted in approximately a central position in the watercraft 10.

In the illustrated embodiment, the engine 60 includes three in-line cylinders and operates on a two-stroke, crankcase compression principle. The engine 60 is positioned such that the row of cylinders lies parallel to a longitudinal axis of the watercraft 10, running from bow to stern. The axis of each cylinder may be skewed or inclined relative to a vertical central plane of the watercraft 10, in which the longitudinal axis lies. This engine type, however, is merely exemplary. Those skilled in the art will readily appreciate that the present exhaust system can be used with any of a variety of engine types having other number of cylinders, having other cylinder arrangements and operating on other combustion principles (e.g., four-stroke principle).

Preferably, the jet pump 44 supplies cooling water through a conduit (not shown) to an engine cooling jacket. For this purpose, an outlet port may be formed on the housing of the jet pump 44. The conduit is coupled to an outlet port and extends to an inlet port for supplying coolant, such as water to the engine cooling jacket. The engine cooling jacket extends through the exhaust manifold, through the cylinder block, about the cylinders, and through the cylinder head assembly. Either the cylinder head assembly or the exhaust manifold can include a coolant discharge port through which the cooling water exits the engine 60 and thence flows through at least a portion of the exhaust system 12.

The personal watercraft 10 so far described represents only an exemplary watercraft on which the present exhaust system 12 can be employed. A further description of the personal watercraft 10 is not believed necessary for an understanding and an appreciation of the present exhaust system 12. The exhaust systems will now be described in detail.

The exhaust system 12 discharges exhaust byproducts from the engine 60 to the atmosphere and/or to the body of water in which the watercraft 10 is operated. The exhaust system 12 is fed exhaust gasses from an exhaust manifold (not shown) that is affixed to the side of the cylinder block of engine 60 and which receives exhaust gases from the combustion chambers through exhaust ports in a well-known manner. For this purpose, the exhaust manifold desirably includes a number of runners equal in number to the number of cylinders. Each runner communicates with the exhaust port(s) of the respective cylinder. The runners of the exhaust manifold thence merge together to form a common exhaust path that terminates at an outlet end of the manifold.

The exhaust manifold may have a dual shell construction formed by an inner wall and an outer wall. A cooling jacket is formed between the two walls and communicates with one or more water passages within the engine block 60. In the illustrated embodiment, coolant flows from the engine block 60 into the cooling jacket of the exhaust manifold; such coolant, however, can be supplied from a different location of the cooling system (e.g., from a location upstream of the engine cooling jacket). This dual wall construction desirably is formed along each runner of the manifold, as well as about the common flow section of the manifold.

Figure 7:
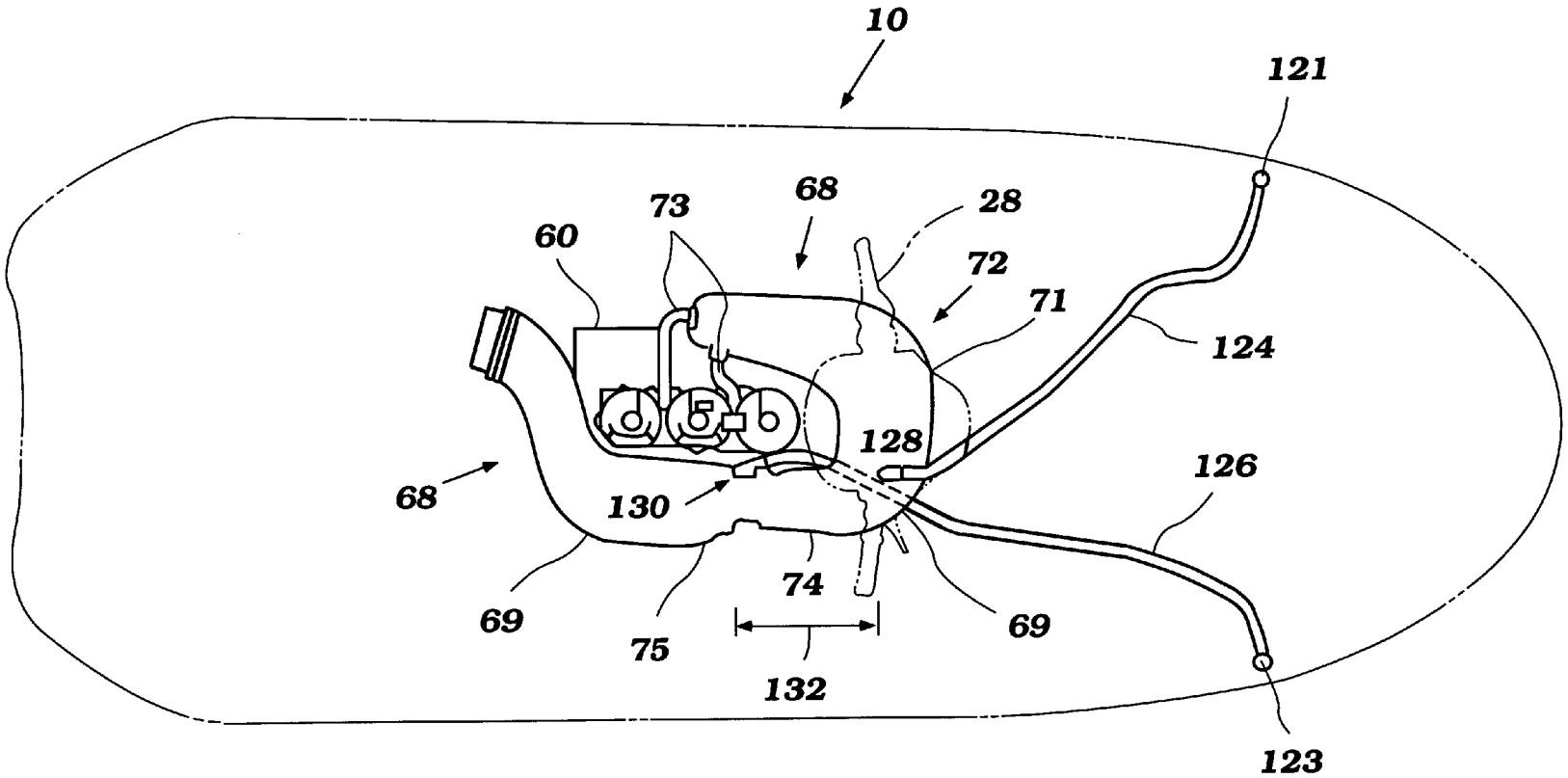
FIG. 7 is a top plan view of the watercraft shown in FIG. 1 schematically representing arrangement of telltale ports.

As shown in FIG. 7, an expansion chamber 72 has a generally tubular shape with an enlarged cross-sectional flow area to allow the exhausts gases to expand and silence, as known in the art. The upstream end of the expansion chamber 72 has a diverging configuration and the downstream has a converging configuration, as is conventional. A thick-wall, which is defined between an inner surface and an outer surface forms the tubular shape of the expansion chamber 72. The inner surface defines the exhaust flow passage through the expansion chamber 72. A plurality of cooling passages (not shown) extend along side the flow passage through the thick wall of the expansion chamber 72. The passages are desirably spaced around the inner surface.

As shown in FIG. 1, the expansion chamber 72 has a reduced cross-sectional outlet portion 74 which directs exhaust gases into a catalytic device 76. The catalytic device 76 desirably includes the catalyst bed 78 which changes at least a portion of the exhaust gases into harmless gases (e.g., carbon dioxide and water). The catalyst bed 78 lies within the exhaust gas flow through the exhaust system 12 at a position that mandates that all exhaust gases must pass through the catalyst bed 78. The catalyst bed 78 reduces the emissions of hydrocarbons and other exhaust products (e.g., carbon monoxide and oxides of nitrogen) from the watercraft engine.

For this purpose, the catalyst bed 78 is formed of a catalytic material, which is designed to render harmless either all or some of the exhaust byproducts. For example, the catalyst bed 78 can be made of a metal catalyst material, such as, for example, platinum. The catalyst bed 78, however, can be made of different types of catalytic materials for treating different exhaust byproducts or lubricants.

The catalyst device 76 is jacketed by a cooling jacket. In the illustrated embodiment, the cooling jacket receives coolant flow from the cooling jacket in thermal contact with the expansion chamber. Other coolant flow path arrangements of course are also possible, as well known in the art.

As shown in FIG. 1, an exhaust passage 68 extends downwardly from the catalytic device 76 and is coupled to a watertrap device 80 by a flexible conduit.

Figure 2:
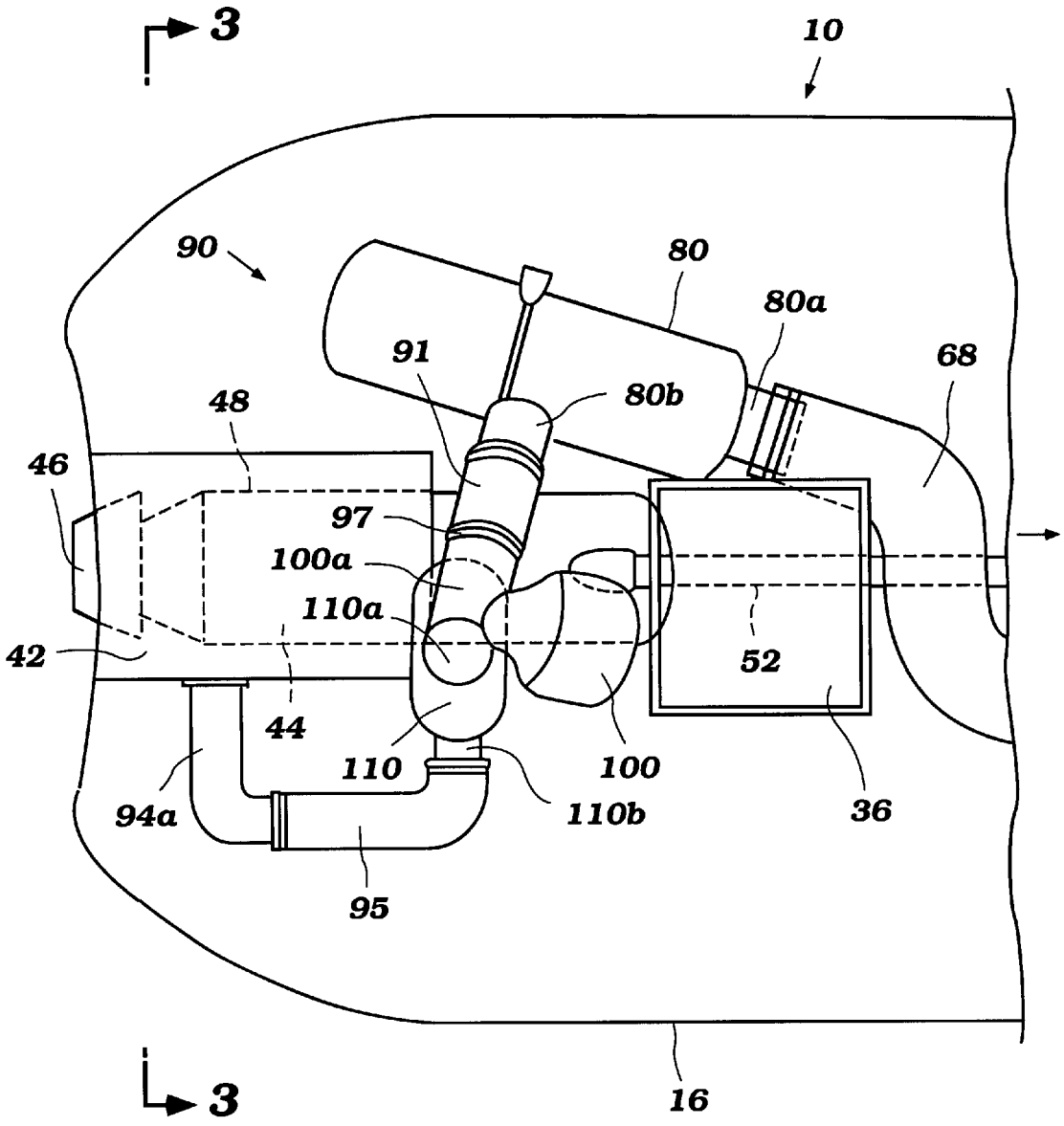
FIG. 2 is a top plan view of a portion of the exhaust system included in the personal watercraft of FIG. 1.

As shown in FIGS. 1 and 2, the watertrap 80 is connected to the exhaust passage 68 via a connector pipe 82. Preferably, the watertrap device 80 is provided with a plurality of internal baffles arranged to retain a predetermined volume of water and to generally suppress the back flow of water toward the catalytic device 76. In order to further inhibit significant flows of water into the watertrap 80 during high speed maneuvering or capsizing, the watercraft 10 is provided with a water preclusion system 90.

The present water preclusion system 90 inhibits a flow of significant volume of water through watertrap 80, and into the catalytic bed 78 and/or the expansion chamber 72. As noted above, if water reaches the catalytic bed 78 during operation of the watercraft 10, the catalytic bed 78 can shatter under some operating condition. Additionally, if water, especially sea water, enters the expansion chamber 72, the exhaust manifold or the combustion chambers of the engine 60, accelerated and/or severe corrosion can occur which often requires expensive and invasive repairs. The present water preclusion system 90 thus inhibits a significant backflow of water through the exhaust system and thereby reduces the likelihood that such repairs to the catalyst device, to the engine, and/or to the balance of the exhaust system will be required.

As shown in FIGS. 1 through 4, the water preclusion system 90 includes an intermediate exhaust passage 92 which extends between the watertrap device 80 and an exhaust discharge 94. Although the passage 92 may be formed monolithically with chambers 100 and 110 (discussed in detail below), the passage 92 is preferably formed of portions 91, 93, and 95, which are constructed from an appropriate material, such as, for example, high temperature rubber or plastic. Depending on which components are included in the system 90, portions 91, 93, and 95, or various combination thereof, are connected via couplings 97 in an known manner.

As shown in FIG. 3, the watercraft 10 floats, in an unloaded state, such that the water line is approximately at the level of an unloaded water line 96. When the watercraft 10 is loaded with the maximum rated weight, the watercraft 10 floats at a depth of approximately the maximum rated water line 98. As shown in FIG. 3, the intermediate exhaust passage 92 extends from the watertrap device 80 at a position below the maximum rated water line 98 above the tunnel 42, and to a position above the maximum rated water line 98, then to a position below the water line 98 and the water line 96 to discharge the port 94. Therefore, when the watercraft 10 is at rest with the maximum rated load, water will flow into the exhaust discharge 94 and up into the intermediate passage 92 only up to the water line 98. Therefore, at least when the watercraft 10 is at rest with the maximum rated load, water should not flow into the watertrap 80.

However, as shown in FIGS. 1–4, the water preclusion system 90 includes the chamber 100 which is branched from and communicates with the intermediate passage 92. As shown in the figures, the chamber 100 communicates with the passage 92 via a throat 104. Preferably, the chamber 100 is in the form of a tuned resonator chamber 102 configured to form a Hemholtz resonator with the throat portion 104, so as to attenuate noise from the engine 60. As shown in FIG. 3, the chamber 100 is arranged so as to communicate with the intermediate passage 92 at a position above the tunnel 42 and/or above the maximum rated water line 98. As an example, the intermediate passage 92 may be formed monolithically with the chamber 100, or, as shown in the figures, the intermediate passage may be formed with the detachable portions 91, 93, and 95 formed of high temperature rubber or plastic and connected via the couplings 97. In this embodiment, the portion 91 connects a watertrap outlet 80*b* with an inlet 100*a*, and the portion 93 connects an outlet 100*b* with an discharge port inlet 94*a*.

Figure 4:
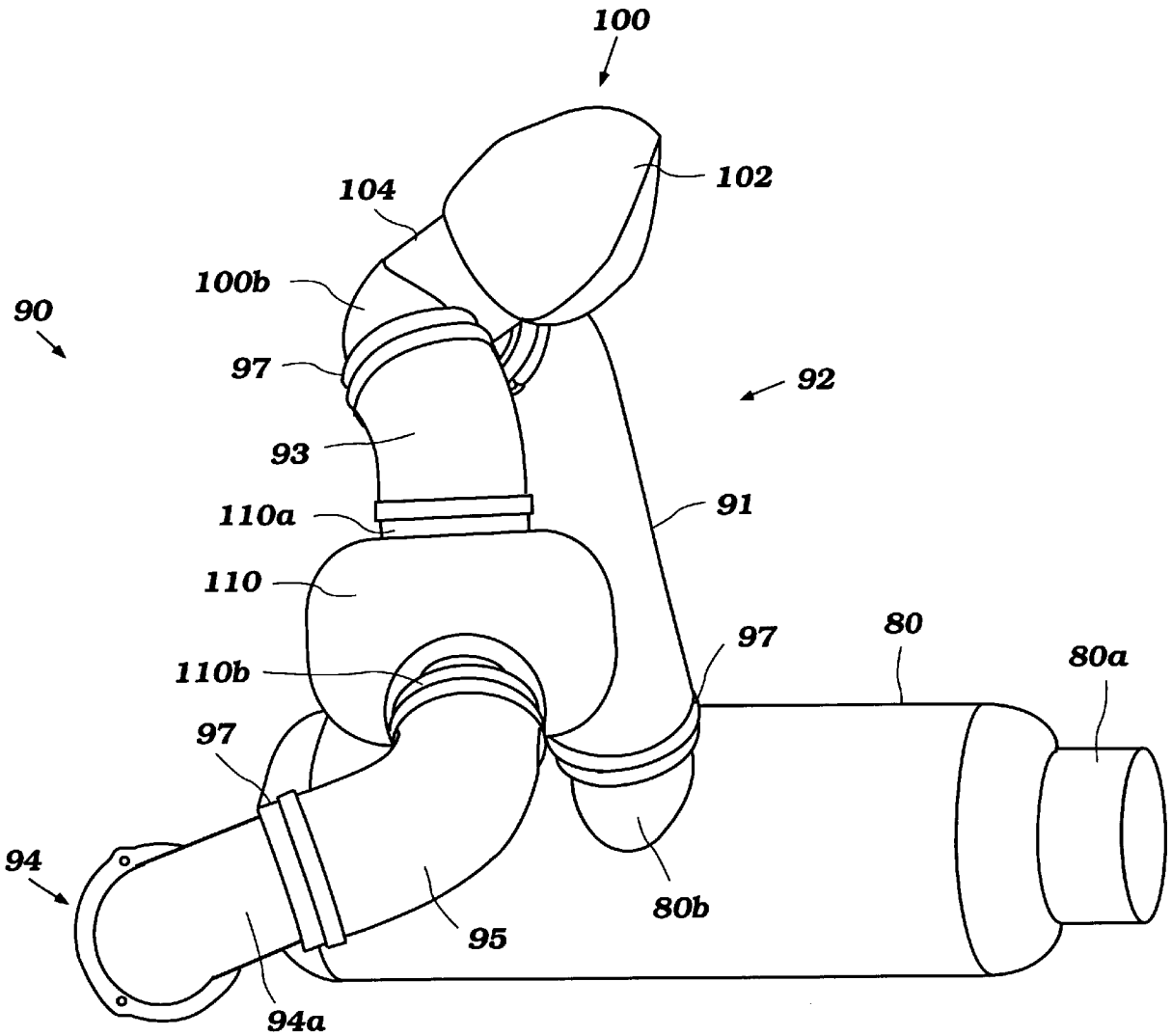
FIG. 4 is a an enlarged perspective view of the exhaust system shown in FIG. 2.
Figure 5:
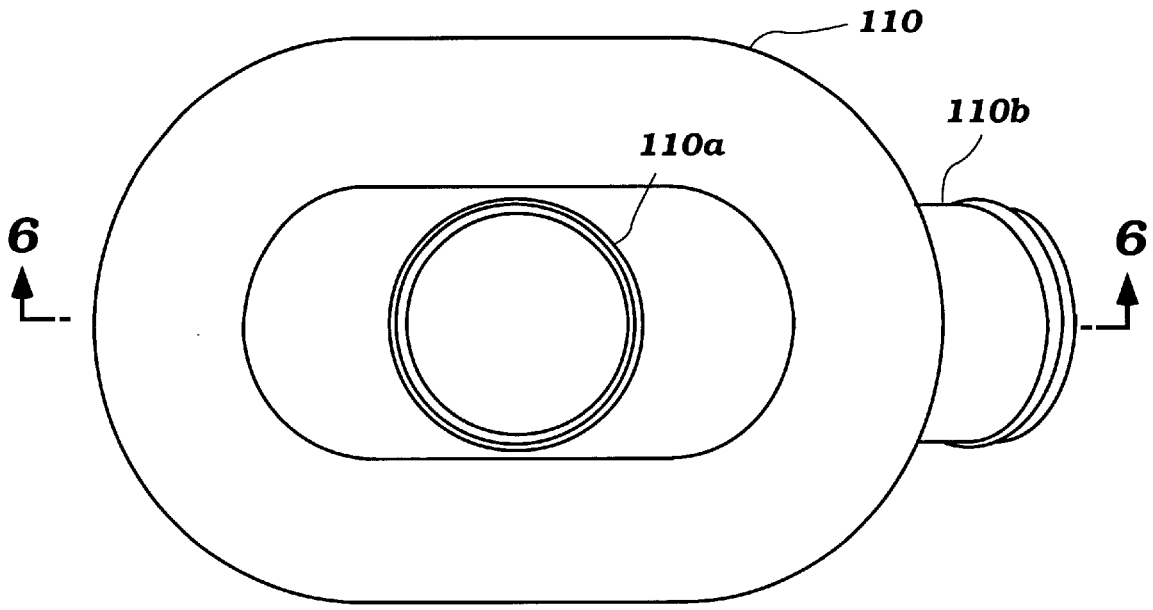
FIG. 5 is a top plan view of a chamber provided in the exhaust system shown in FIG. 4.

As shown in FIGS. 3 and 4, the chamber 100 preferably extends upwardly from the intermediate passage 92. If the watercraft 10 is capsized, thereby causing water to flow towards an apex 106 of the intermediate passage 92, as viewed in FIG. 3, the water will flow into the chamber 100 and will be stored there at least temporarily while the watercraft 10 remains capsized, thereby preventing the water from flowing directly into the watertrap 80.

The chamber 100 preferably communicates with the intermediate passage 92 at a position downstream from the apex 106 of the intermediate passage 92. Arranged as such, the chamber 100 will tend to direct water, which flowed into the chamber 100 during the capsizing of the watercraft 10, downstream from the apex 106 towards the exhaust discharge port 94 after the watercraft 10 has been righted. Therefore, even if the watercraft 10 is capsized with a significant amount of water in the intermediate passage 92, the chamber 100 will temporarily store and return water to the portion of the intermediate passage 92 which is downstream from the apex 106. By providing the chamber 100 as such, the water preclusion system 90 achieves the dual goals of preventing a damaging back flow of water in the exhaust system of a watercraft, and avoiding the power sapping back pressure in the exhaust system. Furthermore, if the chamber 100 is tuned so as to form a heimholtz resonator with the throat portion 104, the system 90 additionally reduces the noises generated by the engine 60 without a significant increase in backpressure.

Figure 6:
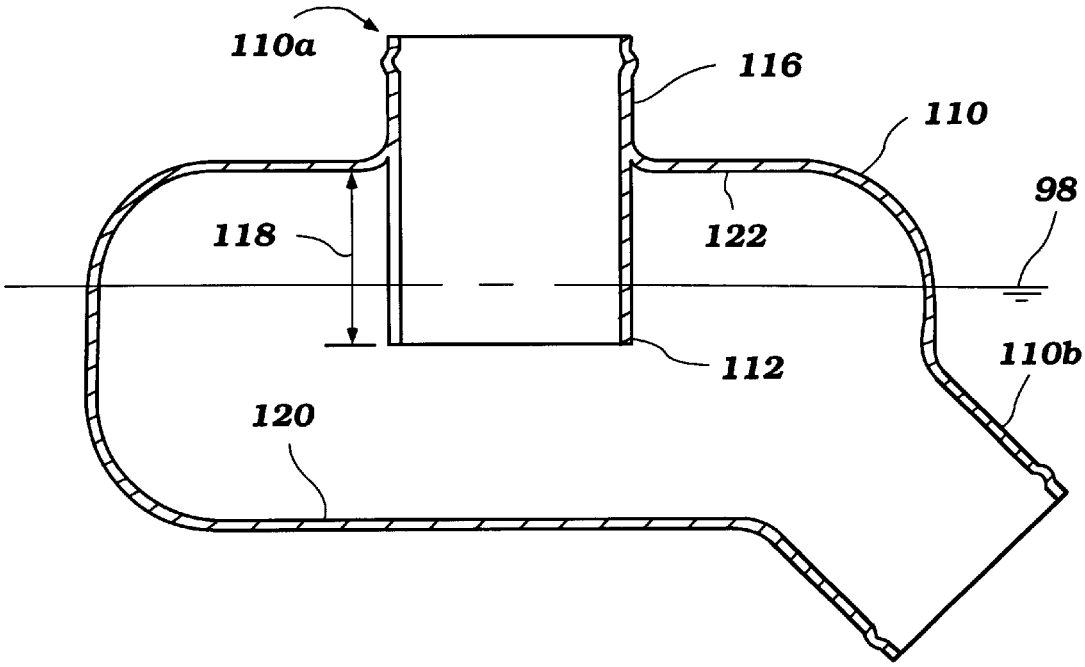
FIG. 6 is a sectional view along line 6—6 shown in FIG. 5.

The water preclusion system 90 may, in addition or in lieu of the chamber 100, include the chamber 110 which communicates with the intermediate passage 92 via an inlet 112 and an outlet 114. As shown in FIG. 3, the chamber 110 has a cross-sectional area that is larger than a cross sectional area of the intermediate passage 92, by virtue of its elongation generally in a horizontal direction. Preferably, a connector 116 extends into the chamber 110 a predetermined distance 118. As shown in FIG. 6, the connector 116 is preferably formed monolithically with the reservoir 110. However, it is conceived that the connector 116 may be formed separately and sealably engaged with the chamber 110. With the chamber 110 included in the intermediate passage 92, the inlet 110*a* of the chamber 110 preferably communicates with the intermediate passage 92 via the portion 93 while the chamber 100 and the outlet 110*b* is connected to discharge the inlet 94*a*.

As shown in FIG. 6, the chamber 110 includes a lower surface 120 and an upper surface 122. Preferably, the chamber 100 is arranged such that the maximum rated water line 98 falls below the upper surface 122. Therefore, a volume of water fills the chamber 110 up to the water line 98 when the watercraft is loaded with its maximum rated load.

Preferably, the chamber 110 and the predetermined distance 118 are configured such that when the chamber 110 is inverted, such as when the watercraft is capsized, the volume of water urged into the chamber 110 when the watercraft 10 is loaded with its maximum rated load, fills the inverted chamber 110 to a depth equal to or less than the predetermined distance 118. Therefore, when the watercraft 10 is capsized, the volume of water trapped within the chamber 110 is not sufficient to flow upstream the past inlet 112. However, it is to be noted that, depending on the events leading to capsizing, more or less water may actually be trapped in the exhaust passage 92 when the watercraft 10 is capsized. However, with the chamber 110 and the predetermined distance 118 configured as such, it has been found that a sufficient amount of water can be prevented from causing a damaging back flow of water from occurring.

Furthermore, if the chamber 110 is used in conjunction with the chamber 100, the chamber 100 may trap any water that may flow past the inlet 112 during capsizing of the watercraft 10. Therefore, by providing the chamber 100 and the chamber 110 to the intermediate portion 92, the exhaust system prevents damaging upstream flow of water that has heretofore plagued personal watercraft. Additionally, if the chambers 100 and 110 are provided together, further tuning, in a known manner, of the chambers 100 and 110, can produce additional attenuation of engine noise.

According to a further aspect of the present invention, a watercraft, such as the watercraft 10, is provided with at least two telltale ports configured to discharge a stream of water to a position forward of the rider's seating area. For example, as shown in FIG. 7, the internal combustion engine 60 includes the exhaust passage 68 which is connected to an exhaust manifold (not shown) at a first end and to a water trap (not shown) at a second end. In order to provide a desired cooling of the exhaust passage 68, a cooling jacket 69 is formed around the exhaust passage 68. A first portion 71 of the cooling jacket 69 is fed with a coolant from a cooling jacket formed in the engine 60 via runners 73.

As shown in FIG. 7, the first portion 71 of the cooling jacket 69 is configured to circulate coolant in thermal contact with the expansion chamber 72. Preferably, the expansion chamber 72 is constricted at the portion 74. Downstream from the portion 74, the expansion chamber 72 is coupled to a downstream portion 75 of the exhaust passage 68. The downstream portion 75 may include a catalytic device such as the catalyst bed 78 for removing pollutants from the exhaust gases in a known manner. As noted above, the cooling jacket 69 extends over the downstream portion 75 of the exhaust passage 68 to cool the catalytic bed 78. Communication between the first portion 71 of the cooling jacket 69 and the downstream portion 75 is accomplished through a known coupling between the portion 71 and the portion 75.

Although it has been known to provide a telltale port on a watercraft in order to verify that coolant is flowing through the appropriate cooling jackets and channels of the engine and the exhaust system, it has been found that a leak or a blockage may be caused at various places within a cooling jacket which may not cause a change in the appearance of the telltale stream sufficient to capture the attention of the user. Therefore, the watercraft is preferably provided with at least two telltale ports configured to discharge a stream of coolant from the cooling jackets 69.

As shown in FIG. 7, the telltale ports 121, 123 are arranged at a position forward of the handle bar 28. As is apparent from FIG. 7, the telltale ports 121, 123 are arranged sufficiently forward of the handle bar 28 so as to be clearly visible to a user seated in the rider's seating position 22.

The telltale ports 121 and 123 are connected to the cooling jacket 69 via conduits 124, 126, respectively. Arranged as such, the telltale ports 121, 123 are clearly visible to a user seated in the rider's seating area 22 regardless of whether a user is looking toward the user's left or toward the user's right. Therefore, the user will be apprised at all times of the operating condition of the cooling system of the watercraft 10.

One of the telltale ports 121,123 preferably is connected to the cooling jacket 69 at a position 128 which is upstream from a position 130 at which the other of the telltale ports 121, 123 is attached to the cooling jacket 69. For example, the positions 128, 130 may be spaced by a distance 132. Preferably, the position 128 is provided on an upstream side of the coupling between the portion 71 and the downstream portion 75 while the position 130 is provided downstream of the coupling. Arranged as such, a user is provided with an indicator of the coolant pressure in two distinct portions of the cooling jacket 69. For example, when a user is operating the watercraft 10, the telltale streams of the coolant are continuously discharged from the ports 121, 123. However, if a leak forms, for example, in the coupling between the upstream portion 71 of the cooling jacket 69 and in the downstream portion 75, the telltale stream discharged from the port 123 will become weaker or non-existent. Therefore, by comparing the appearance of the water streams discharged from the ports 121, 123, a user can identify a leak in the cooling system. This is particularly useful since the exhaust systems of watercrafts, and in particular, those systems that include a catalytic device, operate at high temperature which should be controlled to a particular operating range. Therefore, by providing the user with a reference for detecting a leak in an early stage, severe damage to the catalytic bed and to other components of the watercraft can be prevented. This arrangement provides an improvement over a system with a single telltale port. For example, if a watercraft such as the watercraft 10 is provided only with the telltale port 123, a user can not determine that a blockage in the exhaust system has occurred downstream of the point of the cooling system to which the telltale port is connected. Thus, the user can not determine that coolant flow to a critical component (e.g., a catalyst device) is diminished or stopped. In contrast, by providing at least two telltale ports 121, 123, a user can readily view the two telltale streams and proper coolant flow within this critical section of the cooling system.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A watercraft having a hull defining an engine compartment in which an engine is provided, said engine including at least one exhaust port for discharging exhaust gases from said engine to the atmosphere through an exhaust system, said exhaust system comprising an exhaust passage extending between an exhaust manifold of said engine and an exhaust discharge port provided on a first side of a hull tunnel of said hull, said exhaust passage including a watertrap device provided on a second side of said hull tunnel opposite said first side, said exhaust passage including an intermediate portion extending generally transverse to a longitudinal axis of said hull and extending between said watertrap device and said discharge port, said intermediate portion extending above a top of said hull tunnel, and a first chamber branched from and communicating with said intermediate portion, said first chamber positioned directly above said tunnel.

2. A watercraft as in claim 1, wherein said first chamber branches upwardly from said intermediate portion.

3. A watercraft as in claim 1, wherein said first chamber is provided at a position downstream from an apex of said intermediate portion.

4. A watercraft as in claim 1, wherein said intermediate portion includes a throat provided between said first chamber and said intermediate portion, through which said first chamber and said intermediate portion communicate, and said throat and said chamber being tuned so as to form a Helmholtz resonator to attenuate noise from said engine.

5. A watercraft as in claim 4, wherein said throat and said Helmholtz resonator are arranged so as to branch upwardly from said intermediate portion.

6. A watercraft having a hull defining an engine compartment in which an engine is provided, said engine including at least one exhaust port for discharging exhaust gases from said engine to the atmosphere through an exhaust system, said exhaust system comprising an exhaust passage extending between an exhaust manifold of said engine and an exhaust discharge port provided on a first side of a hull tunnel of said hull, said exhaust passage including a watertrap device provided on a second side of said hull tunnel opposite said first side, said exhaust passage including an intermediate portion extending between said watertrap device and said discharge port, said intermediate portion extending above the top of said hull tunnel, a first chamber branched from and communicating with said intermediate portion and, a second chamber communicating with said intermediate portion at a position between said first chamber and said discharge port, said first chamber having a cross-sectional area larger than a cross-sectional area of said intermediate portion said first chamber positioned directly above said hull tunnel.

7. A watercraft as in claim 6, wherein said first chamber branches upwardly from said intermediate portion, and wherein said second chamber comprises a cavity elongated in a substantially horizontal direction.

8. A watercraft as in claim 7, wherein said second chamber is arranged such that a maximum rated water line of said watercraft loaded with a maximum rated load is below an upper wall of said second chamber.

9. A watercraft as in claim 8, wherein said intermediate portion includes a connector portion extending a predetermined length into an interior of said second chamber.

10. A watercraft as in claim 9, wherein said second chamber and said predetermined length are configured such that an amount of water sufficient to fill said second chamber to the maximum rated waterline is not sufficient to flow past said connector portion when said watercraft is inverted.

11. A watercraft as in claim 9, wherein said intermediate portion includes a throat provided between said first chamber and said intermediate portion, through which said first chamber and said intermediate portion communicate, said throat and said first chamber being tuned so as to form a Helmholtz resonator and to attenuate noise from said engine, and said connector portion and said Helmholtz resonator being tuned so as to provide sound attenuation of the exhaust of said engine.

12. A watercraft having a hull defining an engine compartment in which an engine is provided, said engine including at least one exhaust port for discharging exhaust gases from said engine to the atmosphere through an exhaust system, said exhaust system comprising an exhaust passage extending between an exhaust manifold of said engine and an exhaust discharge port provided on a first side of a hull tunnel of said hull, said exhaust passage including a watertrap device provided on a second side of said hull tunnel opposite said first side, said exhaust passage including an intermediate portion extending between said watertrap device and said discharge port, said intermediate portion extending above the top of said hull, a first chamber branched from and communicating with said intermediate portion and, a cooling jacket configured to circulate a coolant in thermal communication with said exhaust passage, a first telltale port and a second telltale port configured to discharge a stream of the coolant at a position forward of an operator's seating position of said watercraft, said first telltale port communicating with said cooling jacket at a first position, said second telltale port communicating with said cooling jacket at a second position downstream from said first position.

13. A watercraft as in claim 12, wherein said exhaust passage additionally comprises an expansion chamber portion including an expansion chamber and a downstream portion communicating with said expansion chamber portion through an exhaust passage coupling, and extending downstream from said expansion chamber portion, said cooling jacket including a first portion in thermal communication with said expansion chamber portion and a second portion in thermal communication with said downstream portion, said first and second portions of said cooling jacket fluidically communicating through said exhaust passage coupling, said first telltale port communicating with said first portion of said cooling jacket and said second telltale port communicating with said second portion of said cooling jacket.

14. A watercraft having a hull defining an engine compartment in which an engine is provided, said engine including at least one exhaust port for discharging exhaust gases from said engine to the atmosphere through an exhaust system, said exhaust system comprising an exhaust passage extending between an exhaust manifold of said engine and an exhaust discharge port provided on a first side of a hull tunnel of said hull, said exhaust passage including a watertrap device provided on a second side of said hull tunnel opposite said first side, said exhaust passage including an intermediate portion extending between said watertrap device and said discharge port, said intermediate portion extending above a top of said hull tunnel, and a first chamber communicating with said intermediate portion and having a cross-sectional area larger than a cross-sectional area of said intermediate portion, said first chamber provided downstream of an apex of said intermediate portion, said first chamber being disposed relative to a maximum rated water line of said watercraft such that an upper wall of said first chamber lies above said maximum rated waterline.

15. A watercraft as in claim 14, wherein said intermediate portion includes a connector portion extending a predetermined length into an interior of said first chamber.

16. A watercraft as in claim 15, wherein said first chamber and said predetermined length are configured such that an amount of water sufficient to fill said first reservoir to the maximum rated water line is not sufficient to flow past said connector portion when said watercraft is inverted.

17. A watercraft as in claim 15, further comprising a Hemholtz resonator branched from said intermediate portion at a position downstream from an apex of said intermediate portion.

18. A watercraft having a hull defining an operator's seating position and an engine compartment in which an engine is provided, said engine including at least one exhaust port for discharging exhaust gases from said engine to the atmosphere through an exhaust system, said exhaust system comprising an exhaust passage extending between an exhaust manifold of said engine and an exhaust discharge port, a cooling jacket configured to circulate coolant in thermal communication with said exhaust passage, and first and second telltale ports configured to discharge streams of cooling jacket liquid at positions forward of the operator's seating position of said watercraft, wherein said exhaust passage additionally comprises an expansion chamber portion including an expansion chamber and a downstream portion communicating with said expansion chamber portion through an exhaust passage coupling, and extending downstream from said expansion chamber portion, said cooling jacket including a first portion in thermal communication with said expansion chamber portion and a second portion in thermal communication with said downstream portion, said first and second portions of said cooling jacket fluidically communicating through said exhaust passage coupling, said first telltale port communicating with said first portion of said cooling jacket and said second telltale port communicating with said second portion of said cooling jacket.

19. A watercraft as in claim 18, wherein said first and second telltale ports are configured to discharge streams of coolant on opposite sides of said hull.

20. A watercraft having a hull defining an engine compartment, an engine positioned in the engine compartment, the engine including at least one exhaust port for discharging exhaust gases from the engine, an exhaust system comprising an exhaust passage extending between the exhaust port of the engine and an exhaust discharge provided on the hull, a cooling jacket configured to guide coolant into thermal communication with the exhaust passage, a first coolant discharge comprising a first coolant discharge port provided on the hull, a first coolant discharge conduit extending from the first coolant discharge port to a first position along the cooling jacket so as to discharge coolant from the first position along the coolant jacket to the first discharge port, a second coolant discharge port provided on the hull, and a second coolant discharge conduit extending from a second position along the cooling jacket to the second coolant discharge port so as to discharge coolant from the second position along the coolant jacket to the second discharge port.

21. The watercraft as in claim 20, wherein the first and second discharge ports are arranged on opposites sides of the longitudinal axis of the hull.

22. The watercraft according to claim 20, additionally comprising a steering assembly, the first and second discharge port being arranged such that streams of coolant discharged from the first and second coolant discharge ports are visible to a rider operating the steering assembly.

23. The watercraft according to claim 22, wherein the first and second coolant discharge ports are arranged forward from the steering assembly.

24. A watercraft having a hull defining an engine compartment, a seat pedestal defining at least an operator's seating position being arranged above the engine compartment, a seat removably attached to the seat pedestal, a storage container defined beneath the seat, a tunnel formed on a lower surface of the hull at an aft end of the hull, a propulsion device positioned within the hull tunnel, an engine disposed in the engine compartment configured to drive the propulsion device, the engine including an exhaust port for discharging exhaust gases from the engine, a first exhaust conduit extending from the exhaust port to a watertrap device, the watertrap device being positioned on a first side of the tunnel, the second exhaust conduit extending from the watertrap device over the hull tunnel to an exhaust discharge on a second side of the hull tunnel opposite the first side for discharging exhaust gases to the atmosphere, and a chamber positioned directly above the hull tunnel and communicating with the second exhaust conduit, the chamber being positioned between a wall of the storage container and a rear wall of the engine compartment.

25. The watercraft as in claim 24, wherein the chamber is spaced from the storage cavity.

26. The watercraft as in claim 24, wherein the chamber forms a Helmholtz resonator.

* * * * *